United States Patent [19]

Hume

[11] Patent Number: 4,996,013

[45] Date of Patent: Feb. 26, 1991

[54] METHOD FOR RAPID MOLDING OF ELONGATE CONCRETE ARTICLES

[76] Inventor: Graeme R. Hume, 29 Clark Road, Ivanhoe, Victoria, Australia

[21] Appl. No.: 311,593

[22] Filed: Feb. 16, 1989

Related U.S. Application Data

[63] Continuation-in-part of Ser. No. 44,846, May 14, 1987, abandoned.

[30] Foreign Application Priority Data

Jun. 18, 1985 [AU] Australia ..... 1089

[51] Int. Cl.[5] ..... B28B 1/26; B28B 7/32; B28B 21/08; B28B 21/20

[52] U.S. Cl. ..... 264/86; 249/65; 249/113; 249/152; 249/178; 264/219; 264/314; 264/333; 425/84; 425/417

[58] Field of Search ..... 264/333, 335, 314, 313, 264/86, 87, 219; 249/65, 113, 141, 152, 153, 178, 179, 183; 425/84, 85, 417

[56] References Cited

U.S. PATENT DOCUMENTS

| | | | |
|---|---|---|---|
| 1,418,859 | 6/1922 | Zwicker | 425/406 X |
| 2,579,801 | 12/1951 | Crom et al. | 264/315 X |
| 2,882,582 | 4/1959 | McLennan | 249/65 |
| 3,034,192 | 5/1962 | Maillard | 264/87 |
| 3,056,183 | 10/1962 | Pigeot | 100/269 A |
| 3,107,158 | 10/1963 | Ahlberg | 264/71 |
| 3,998,918 | 12/1976 | Grawey et al. | 264/314 X |

FOREIGN PATENT DOCUMENTS

| | | |
|---|---|---|
| 429/31 | 1/1931 | Australia . |
| 229102 | 4/1959 | Australia . |
| 278201 | 9/1963 | Australia . |
| 281262 | 1/1965 | Australia . |
| 1100126 | 9/1955 | France . |
| 88342 | 6/1946 | New Zealand . |
| 2137924 | 10/1984 | United Kingdom . |

*Primary Examiner*—Jan H. Silbaugh
*Assistant Examiner*—Karen D. Kutach
*Attorney, Agent, or Firm*—Bell, Seltzer, Park & Gibson

[57] ABSTRACT

An inner mold construction and an outer mold construction are provided to define a mold cavity or shape into which wet or uncured concrete is introduced. The method includes the sequential steps of compressing the concrete by movement of the inner mold relatively toward the outer mold to remove surplus liquid from the inner surface of the concrete so that the concrete is at least partially cured. The compression applied on the inner surface of the concrete by the inner mold is maintained while inward pressure is applied over the outer surface of the concrete by the outer mold to remove surplus surface liquid from the outer surface of the concrete. The inner and outer surface pressures on the concrete are released to release the molded article from the mold so that it may be separated therefrom.

5 Claims, 5 Drawing Sheets

METHOD FOR RAPID MOLDING OF ELONGATE CONCRETE ARTICLES

REFERENCE TO RELATED APPLICATION

This application is a continuation-in-part of copending application Ser. No. 07/044,846, filed May 14, 1987, now abandoned.

FIELD OF THE INVENTION

The present invention relates to a method for the rapid molding of elongate concrete articles, such as concrete pipes or poles, and more particularly to a method for molding reinforced concrete pipes or hollow poles in which both the inner and outer surfaces are compressed to facilitate rapid drying while providing an acceptable external surface finish.

BACKGROUND OF THE INVENTION

In my earlier Australian Patent Application No. 27199/84 there is disclosed a process and apparatus for forming an elongate concrete molded article from high slump concrete wherein surplus liquid is removed through a porous membrane extending around the outer perimeter of the article when the membrane is arranged to provide compression to the concrete within the mold and thereafter separating the membrane from the surface of the partially dried concrete and removing the article from the mold without significant damage to the cast concrete article. This enables almost immediate reuse of the mold.

A disadvantage of this method is that the external periphery of the concrete article, although visually undamaged, is not smooth. Furthermore, the process disclosed therein cannot be easily utilized by application of a membrane to the internal periphery of the article.

SUMMARY OF THE INVENTION

It is an object of the present invention to provide a method for rapid molding and drying process of elongate hollow concrete articles formed of concrete having high slump characteristics and while leaving an acceptable external surface finish particularly suitable for use on hollow street poles. It will, of course, be appreciated that either hollow poles or pipes may be manufactured by the present process.

According to the present invention a process is provided for forming an elongate molded hollow article made from a settable material, such as concrete, and including the steps of forming a mold defining an inner and an outer surface corresponding to opposed surfaces of the molded article formed therein, the mold being arranged whereby the inner surface is movable relative to the outer surface and the outer surface is movable relative to the inner surface; filling the mold with the settable material, compressing the settable material by movement of both the inner and outer surfaces towards each other to remove surplus liquid from the settable material such that the settable material is given the characteristic of being at least partially cured, thereafter moving the inner and outer surfaces relatively away from each other to release the article from the mold, and then separating the mold from the article.

Conveniently, the inner and the outer surfaces of the mold are arranged to form an elongated annular mold cavity therebetween whereby a hollow pipe or pole may be formed thereby. In such a case the inner surface is arranged to move radially towards and away from the outer surface and the outer surface is arranged to move radially towards and away from the inner surface.

In some cases practical problems may be encountered in removing excess moisture from the outer surface of the molded article. If the excess moisture is not removed, it may cause difficulties in achieving a smooth outer finish on the article even with careful peeling of the mold therefrom. In the light of this, it is particularly preferred to provide means associated with the outer surface of the mold to remove any excess moisture from the outer surface of the molded article. Conveniently this may be achieved by, at least during part of the process, applying substantially uniform pressure to both inner and outer surfaces of the molded article to cause migration of residual water from the inner and outer surfaces of the molded article. Additionally, the outer mold surface may be provided with a layer of absorbent material adapted to absorb surface moisture from the molded article prior to separating the mold therefrom.

In accordance with the method of the present invention, there is provided a molding apparatus for producing an annular elongate hollow article from a settable material such as concrete. The apparatus includes an outer mold construction defining an inwardly facing mold surface adapted to form an outer surface of the article molded therein, an inner mold construction adapted for location within the outer mold construction and defining an outwardly facing mold surface adapted to form an inner surface of the article molded therein. The inner and outer mold constructions define an elongated annular mold cavity therebetween. The inner mold construction further includes means for moving the inwardly facing mold surface radially towards the outer mold construction and moisture transference means associated with the outwardly facing mold surface to pass moisture formed on the inner surface of the article molded therein away from the inner surface when the settable material within the mold cavity is compressed by relative movement between the outwardly and the inwardly facing mold surfaces. The apparatus further includes means for introducing the settable material within the mold cavity.

The outer mold construction is formed in two halves, each half being covered on the inside with a resilient membrane to form a smooth outer surface on the molded article. The resilient membrane provides pressure applying means for applying and releasing substantially uniform inward pressure to the outer surface of the settable material to remove surface moisture and to minimize surface damage.

BRIEF DESCRIPTION OF THE DRAWINGS

The invention will be described in greater detail with reference to preferred embodiments illustrated in the accompanying drawings, in which.

DESCRIPTION OF THE PREFERRED EMBODIMENTS

Figure 1:
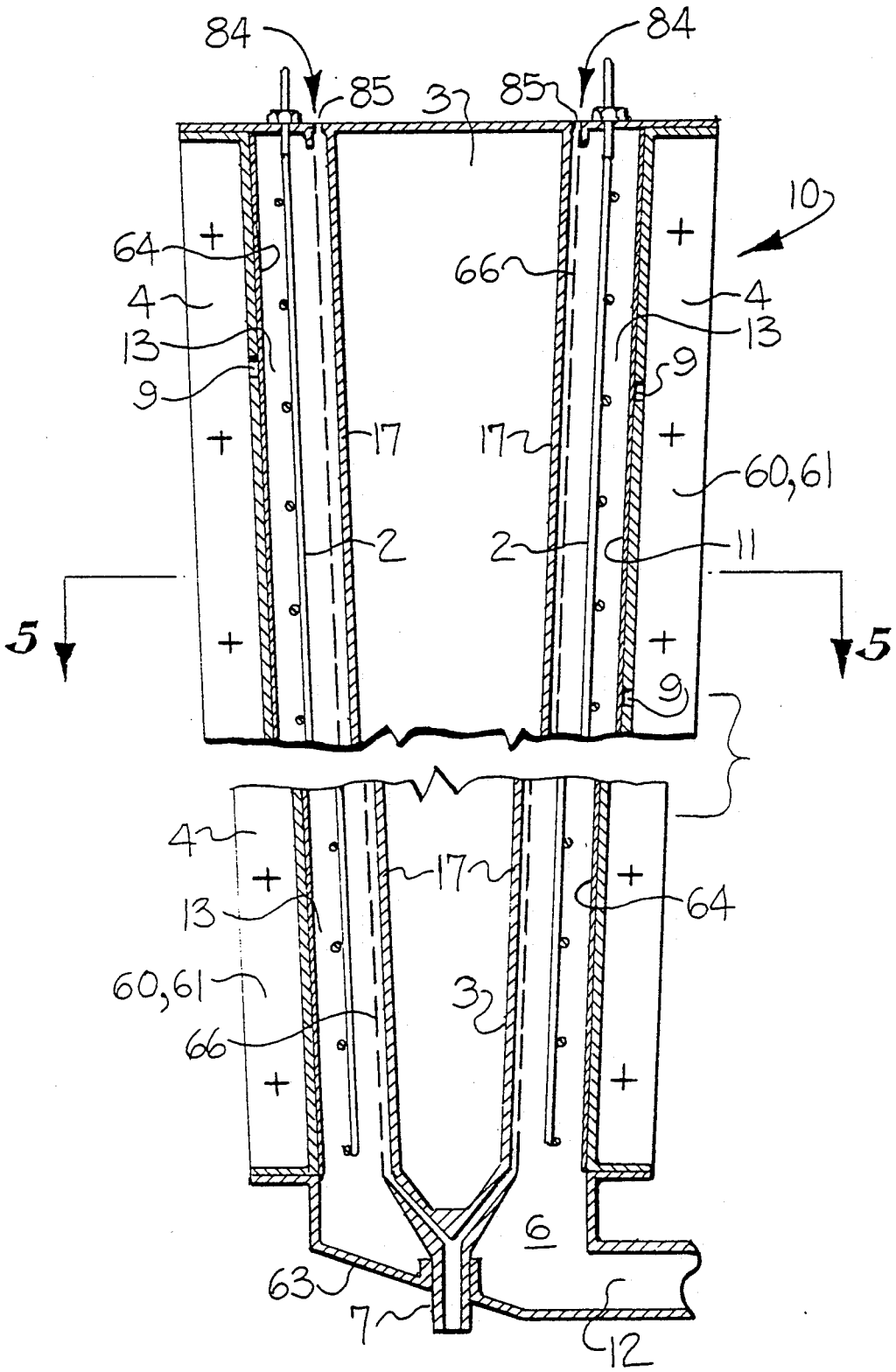
FIG. 1 is a schematic sectional view of the present mold assembly, with the central portion being broken away.
Figure 5:
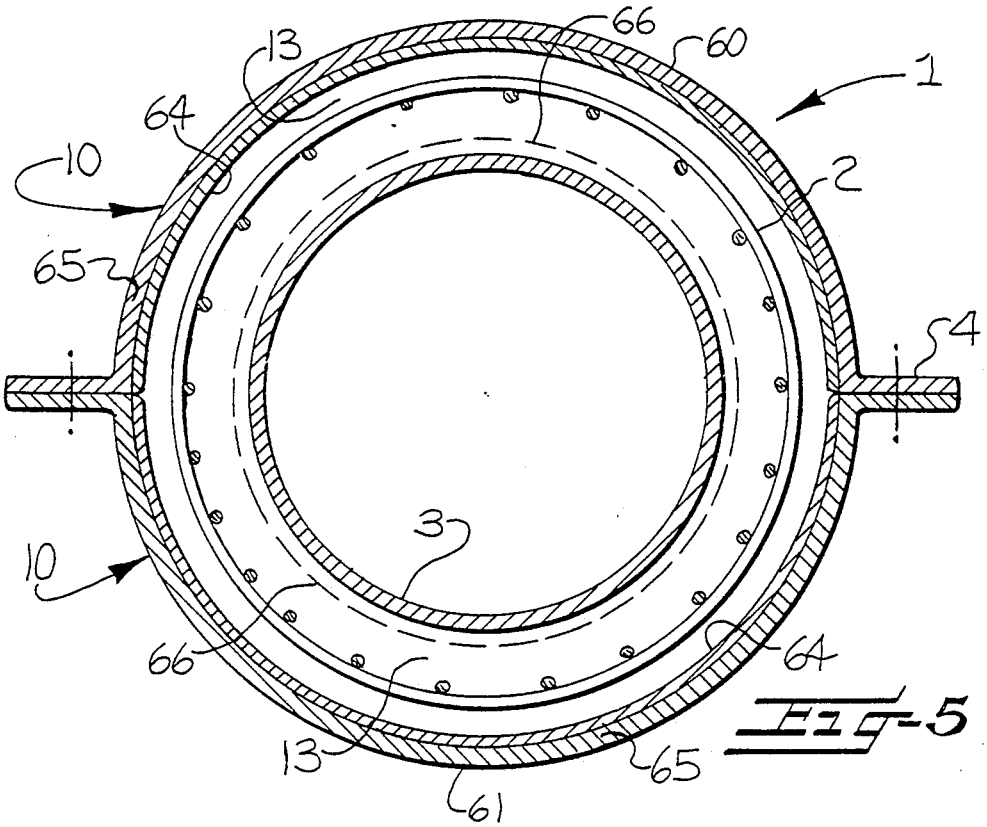
FIG. 5 is a schematic transverse sectional view of the inner and outer mold constructions taken along lines V—V of FIG. 1.

With reference to FIGS. 1 and 5, an outer mold construction, broadly indicated at 10, is shown as being formed in two semi-cylindrical halves 60, 61, closed around an inner mold construction, broadly indicated at 3. The outer mold halves 60, 61 include outwardly extending flanges 4 which may be bolted to the flanges of the other outer mold half or preferably releasably held with hydraulic clamping jacks (not shown). A reinforcing cage 2 of known construction is positioned concentrically within an annular space 13, defining a mold cavity, formed between the inner and outer mold constructions 3, 10.

A lower mold closing body 63 is provided with a concrete feed inlet 12 communicating with a chamber 6 for receiving pumped concrete and for introducing concrete into the annular mold cavity 13. A drainage extension member 7 permits the egress of liquid from the mold assembly and also serves to locate the inner mold 3. The concrete used is preferably high slump (or very wet) in consistency and the pumping pressure is such as to force the concrete from the bottom up to the top of the mold cavity 13. It will, of course, be appreciated that alternative concrete introduction methods may be employed. For example, a suitably shaped tremmie may be introduced into the mold cavity 13 from one end to a position adjacent the other end and thereafter progressively withdrawn while introducing high slump concrete into the cavity.

Figure 2:
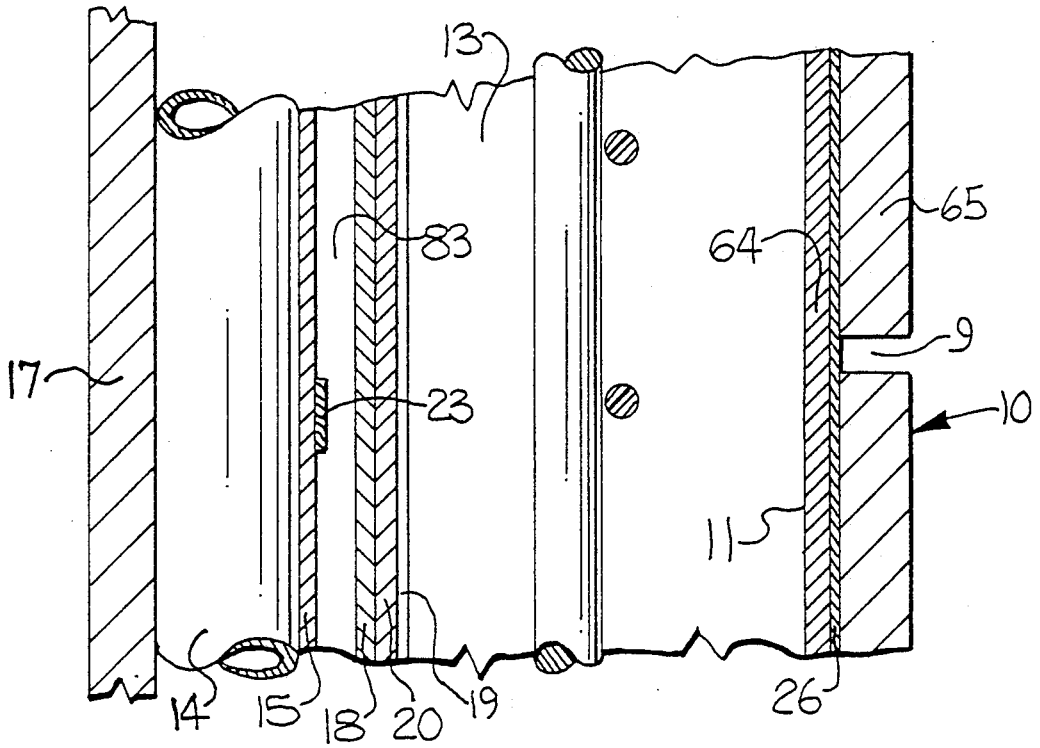
FIGS. 2 and 3 are partial longitudinal and transverse sectional views, at an enlarged scale, through the mold assembly of FIG. 1.
Figure 3:
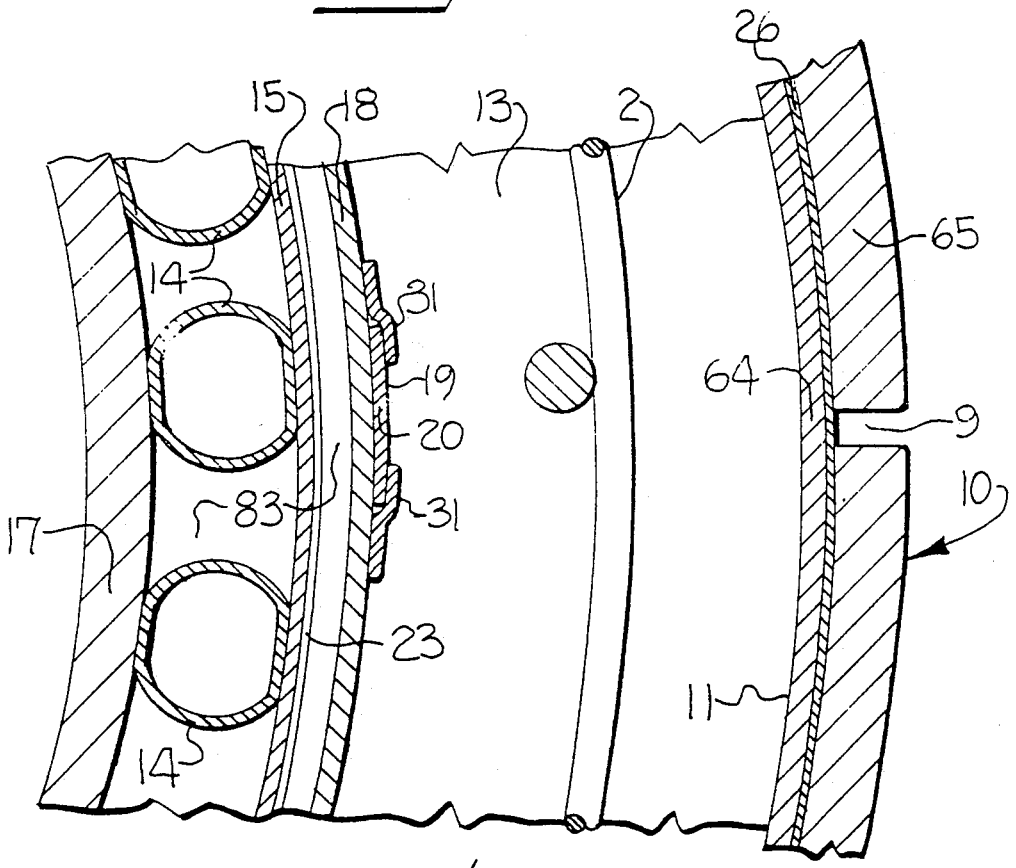

FIGS. 2 and 3 show partial longitudinal and transverse sectional views of the inner and outer mold constructions 3, 10. The outer mold construction 10 includes a substantially rigid supporting outer shell 65 and an inner liner construction 64. As seen in FIGS. 2 and 3, the inner liner construction 64 includes an inner impervious resilient rubber or plastic material membrane 11 and a porous or permeable membrane 26 located between the inner membrane 11 and the outer shell 65. The membrane 11 preferably has a smooth inwardly facing surface defining the outer mold surface and may be arranged continuous over the inner surfaces of the outer mold halves 60, 61. The membrane 11 forms a part of pressure applying means for applying and releasing substantially uniform inward pressure to the outer surface of the settable material, in a manner to be presently described.

The inner mold construction 3 is adapted to provide compression against the inside surface of wet concrete located in the mold cavity 13 and to ensure adequate clearance permitting insertion and removal of the inner mold without fouling other mold assembly components or the molded article itself. The inner mold construction 3 includes a substantially rigid supporting inner former 17 and inner movable wall construction 66, indicated in dotted lines in FIG. 1, having an outwardly facing inner mold surface adapted to contact the concrete located in the mold cavity 13. The wall construction 66 includes inflatable longitudinal tubes 14 (FIGS. 2 and 3) extending the length of the mold assembly, metal sheath 15 and at least one circumferential biasing band 23 of elastic material. An inner impervious membrane 18 is mounted top to bottom of the mold, and at regular intervals around the inner membrane 18 there are longitudinally extending filters 19 and moisture drainage galleries 20.

As is apparent in FIGS. 1 to 3, a series of openings 9 are provided extending through the outer mold shell 65. These openings 9 are adapted for connection to a source of pressurized air and a source of vacuum whereby pressure is applied to the inner liner construction 64 to force same inwardly or to draw the liner construction 64 against the inner contour of the shell 65 for reasons explained hereinafter. This movement of the inner liner construction 64 is achieved because its longitudinal edges and peripheral top and bottom edges are bonded or otherwise secured in a substantially gas tight manner to the outer shell halves 60, 61.

Similarly, air pressure and vacuum applying means (not shown) are provided to connect the inner regions of longitudinally directed tubes 14 and separately the circumferential spaces 83 between the inner impervious membrane 18 and the inner former 17 outwardly of the tubes 14 with either pressurized air or vacuum. This is diagrammatically shown by arrows 84 and openings 85 shown in FIG. 1. The reason for this capability will be explained hereinafter.

Figure 4:
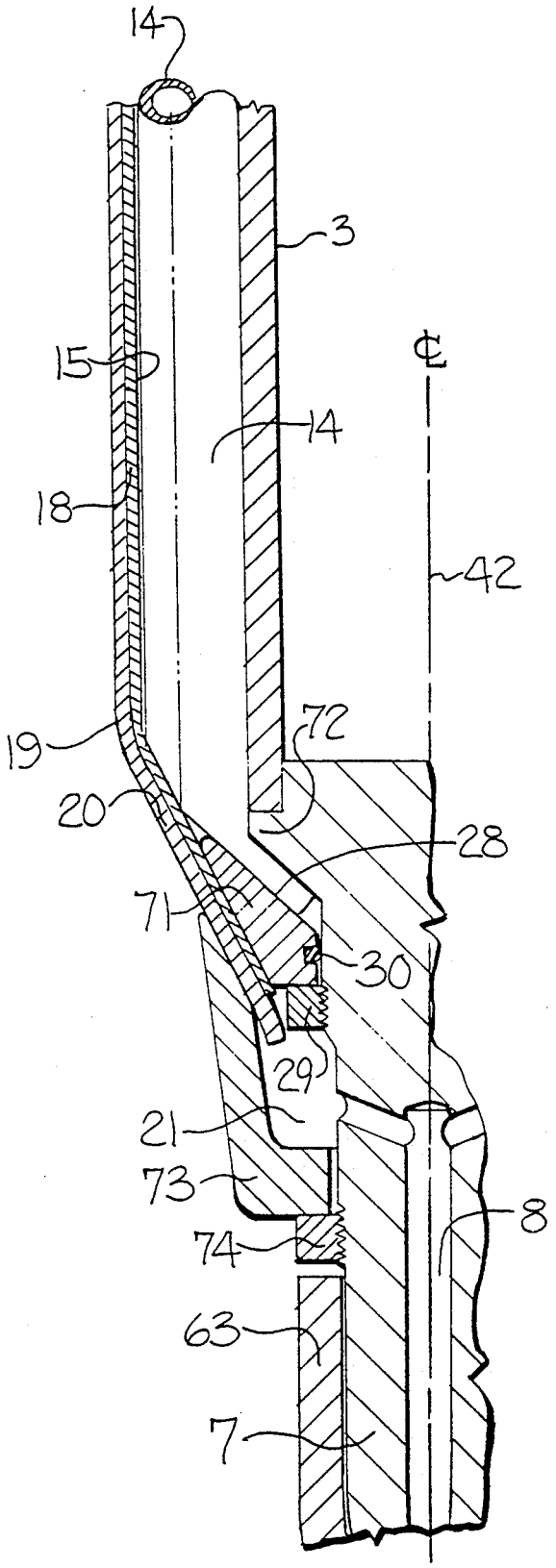
FIG. 4 is an enlarged partial longitudinal sectional view of the bottom of the outwardly facing inner mold surface of FIG. 1.

As best illustrated in FIGS. 1 and 4, any liquid transferred from the inner surface of the concrete after introduction to the mold cavity enters the drainage galleries 20 through filters 19 and passes downwardly to the base of the mold assembly where it is deposited into an annular drainage chamber 21 (FIG. 4). FIG. 4 of the drawings illustrates, in partial section, the lower end of the inner mold construction 3. The center line of this mold assembly is represented by numeral 42 and the non-illustrated half of the construction is an identical mirror image to that portion illustrated in FIG. 4. It will be seen that the lower ends 28 of each of the longitudinal tubes 14 are sandwiched between and closed (or flattened) by an annular wedge element 71 and an abutment 72 on the drainage extension member 7. An O-ring sealing member 30 prevents the escape of any significant pressure from either the tubes 14 or the annular space surrounding the tubes. The wedge element 71 is forced upwardly against the tube ends 28 by tightening a nut and screw connection 29. The annular drainage collection chamber 21 is formed by an annular member 73 surrounding the member 7. A nut 74 is screwed into the member 7 and forces the upwardly divergent free edge of the member 73 against the membrane assembly 18, 19 and 20. In this manner, the collection chamber 21 is formed between the element 73 and the member 7 into which the lower ends of the drainage galleries 20 extend. Thus excess liquid may drain from the galleries 20 via the chamber 21 and outwardly of the mold assembly through central passage 8.

Figure 8:
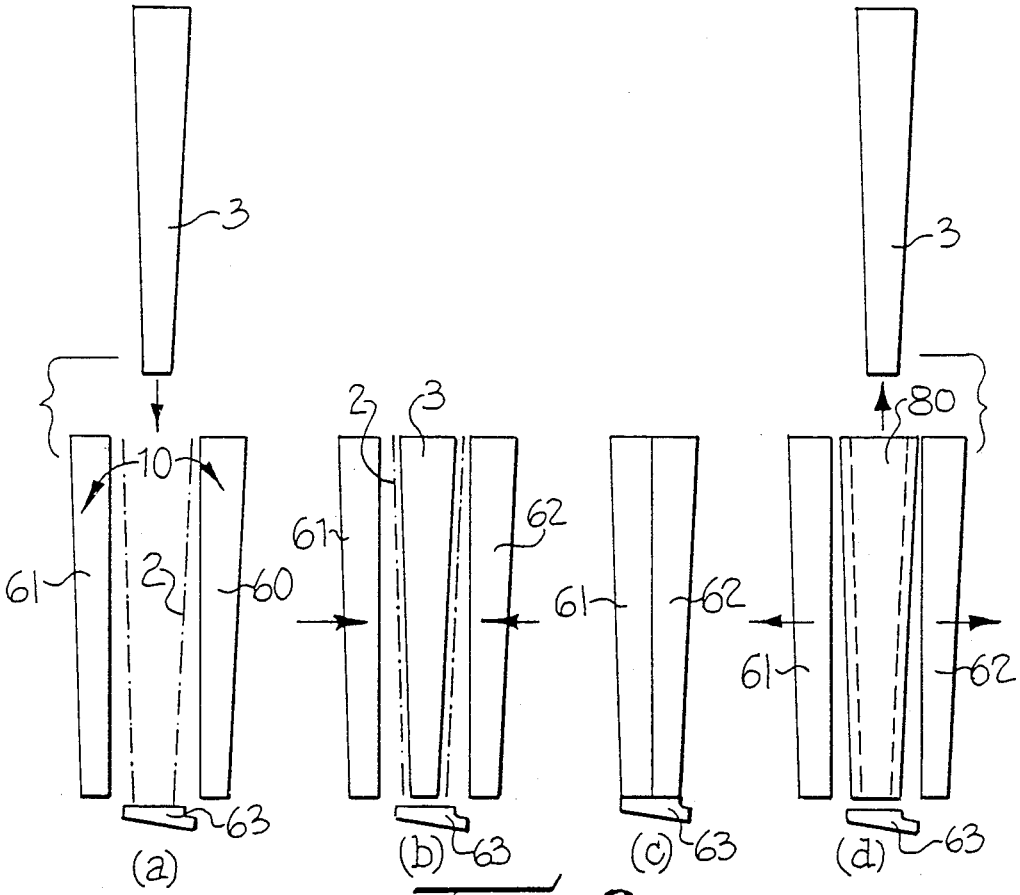
FIGS. 8(*a*) to 8(*d*) are schematic process diagrams applicable to the embodiments of both FIGS. 1 to 5, and FIGS. 6 and 7.

A brief description of the method of operation of this mold assembly will hereinafter be made with reference to FIG. 8. At the start of the molding process the inner mold construction 3 is in a withdrawn or raised position above the outer mold construction 10 and the two outer mold halves 60, 61 are separated from each other, as shown in FIG. 8*a*. The inner mold construction 3 is then lowered into position inside and concentric to a suitably placed reinforcing cage 2 of conventional design (FIG. 8*b*). If one uses a tremmie for the introduction of concrete into the mold cavity, it is preferred that the tremmie be lowered simultaneously with or prior to positioning of the inner mold construction 3. The outer mold halves 60, 61 are then positioned around the cage 2. The base 63 and the upper section (not shown in FIG. 8) for connecting regions of the mold to pressurized air or vacuum are then moved to close the upper and lower ends of the mold assembly (FIG. 8*c*). A partial vacuum may at any suitable stage be introduced through the holes 9 in mold wall 65 to ensure that the flexible membrane 11 conforms to the inner shape of the mold wall 65. With the outer mold halves 60, 61 in a closed condition (FIG. 8*c*) forming a concrete-tight joint at adjoining longitudinal flanges 4 and the base section 63 appropriately fitted to the bottom end of mold halves, air pressure (or other pressurized gas) is then applied to the inside of the collapsible tubes 14 to expand the sliding steel formers 15 as shown in FIG. 3. In this manner, a rigid form of predetermined diameter is achieved by the expansion of the forms 15 by the tubes 14. The pressure within the tubes should be sufficient to withstand the pressure of pumping of concrete into the cavity 13 and may be over 100 psi. High slump (very wet) concrete is then pumped through the concrete feed inlet 12 of the base section 63 through the chamber 6 and into the mold cavity 13 until mold cavity is full. Air may be vented from the mold cavity through a hole in the top mold construction 10. Alternatively, if a tremmie is used concrete may be introduced at a much lower pumping pressure or possibly even arranged to gravitate into the mold cavity 13. During introduction of concrete into the cavity 13, pressure is maintained in the tubes 14 to maintain the outer surface of membrane 18 at the desired predetermined diameter.

When the mold cavity 13 is full and the mold assembly closed, pressure may then be introduced to the space 83 between the longitudinally extending tubes 14 and thereby to the expandable membrane 18 which is thereby pressed against the inner surface of the concrete in the cavity 13 to thereby compress the same. Fitted to the membrane 18 at spaced locations therearound are the filters 19 covering drainage galleries 20. These filter membranes 19 are also pressed against the concrete causing excess water in the mix to pass through the filter 19 and into the drainage gallery 20 between the filter 19 and the rubber membrane 18. The filters 19 and drainage galleries 20 are fastened in position around membrane 18 by fastening strips 31. The water passes downwardly along each of the galleries 20 into the annular space 21 (best seen in FIG. 4) and out to atmosphere through hole 8 in the drainage stem 7. Vibration may be applied if desired to the outer mold construction 10 to assist with the removal of water and the compaction of the concrete.

As discussed earlier in this specification, one possible problem which arises in the practice of the present invention lies with the possibility of excess moisture levels appearing at the outer surface of the molded article. To solve this problem, the process of this invention is further modified in that when compression against the inner surface of the concrete is at or near maximum pressure, as applied by the inner mold, inward pressure is then applied to the outer impervious membrane 11 to apply inward pressure to the outer surface of the concrete and to thereby move substantially all excess surface moisture from the outer surface of the concrete toward the inner surface. The application of inward pressure against the outer surface of the concrete acts to substantially dry the outer surface of the concrete. Pressure is applied to membrane 11 to effect this inwardly directed pressure on the outer surface of the concrete. Thus pressure is being applied through apertures 9, while pressure is also maintained on the inner concrete surface by the inner mold 3.

In a further preferred aspect of the invention the impervious membrane 11 may be replaced by a laminate, including compressible water absorbent material such that during inwardly directed compression of the concrete, moisture is removed from the concrete and upon removal of compression forces excess water is absorbed by the absorbent material. With reference to the above-mentioned absorbent material modification, there may be attached to the membrane 11 (FIGS. 1 to 3) a thin layer, say 1 mm thick, of a compressible absorbent cloth such as chamois or synthetic chamois. Laminated or otherwise attached to the cloth may be a layer of permeable nylon material or the like similar to the permeable filter layer 19. Both layers would be permeable to water and would function as described below.

The layer of nylon forms the liner for the outer surface of the molded concrete and water is able to pass freely through it into the absorbent compressible cloth layer. When the mold is filled with concrete and outward pressure is applied as described by membrane 18, the cloth layer is compressed and will not take up any significant amount of water such that water is passed back into the concrete and out through the filter 19 as described. When the concrete is ready to be stripped, the outer mold 10 is moved radially out and the cloth layer expands to enable absorption of excess moisture at the outer surface of the concrete. This method will remove all excess water from the concrete surface effectively, however, it suffers from a disadvantage in that fine particles of cement lodge in the nylon and absorbent cloth and eventually hydrate and clog the cloth making it useless. The fine cement particles must, therefore, be carefully and frequently cleaned from the laminate.

When excess water has been removed from both the inner and outer surfaces of the cast concrete product, the pressure applied to cavity 83 and membrane 11 is released. It is generally of some importance that the pressures be released substantially simultaneously from cavity 83 and the membrane 11. The pressure applied to the inside of tubes 14 is also released. This step of releasing pressure from within the tubes 14 might also be carried out immediately after the membrane 18 is expanded, thereby reducing the need for vacuum to be applied to the tubes 14. With pressure reduced in the cavity 83, elasticity of the membrane 18 then applies a radially inward force to the metal formers 15 which in turn cause collapsible tubes 14 to deform and become flattened. This action is, of course, also assisted by elastic rings 23. If desired, to assist in flattening of the tubes 14, a vacuum may be communicated with the interior of the tubes 14. Thereby a gap is created between the rubber membrane 18 and the inner surface of the concrete molded article 80.

The inner mold 3 can then be drawn out of the molded concrete article 80, as shown in FIG. 8*d*. The clamping means 25 holding the outer mold halves 60, 61 together is released and low air pressure is applied through each hole 9 into the space between the flexible membrane 11 and the outer shell 65. The permeable membrane 26 enables this pressure to be distributed evenly over the area of the flexible membrane 11. The permeable membrane 26 may be a woven nylon or the like. This air pressure gently presses the shell 65 of the mold halves 60, 61 away to create a peeling action of the membrane 11, much of which may remain stuck to the concrete. If this occurs, the membrane 11 may be drawn radially outwardly by thereafter applying a vacuum through holes 9. This releases the membrane from the concrete with a peeling action which does not damage the body of the concrete article 80. The inner surface at least of the membrane 11 is relatively smooth, leaving a relatively smooth finish on the concrete surface.

The formed concrete can then be removed from the mold supported by the reinforcement cage 2 which extends upwardly beyond the molded concrete. It is, of course, also possible to use prestressed wires or rods in casting concrete articles of this type either in addition to or in replacement of the reinforcing cage 2 described in the foregoing. When this is done, it is preferred to move the cast article by gripping projecting lengths of the prestressed wires or rods.

Figure 6:
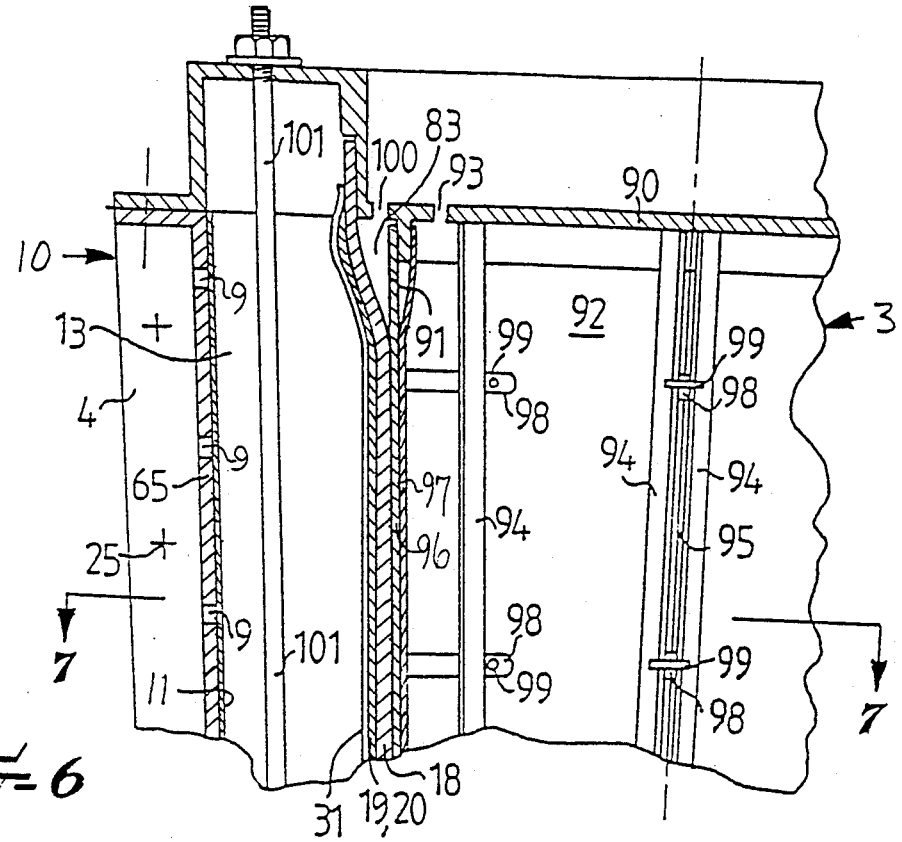
FIG. 6 is a partial longitudinal sectional view of an alternative embodiment to that shown in FIGS. 1 to 5, being taken along line VI—VI of FIG. 7.
Figure 7:
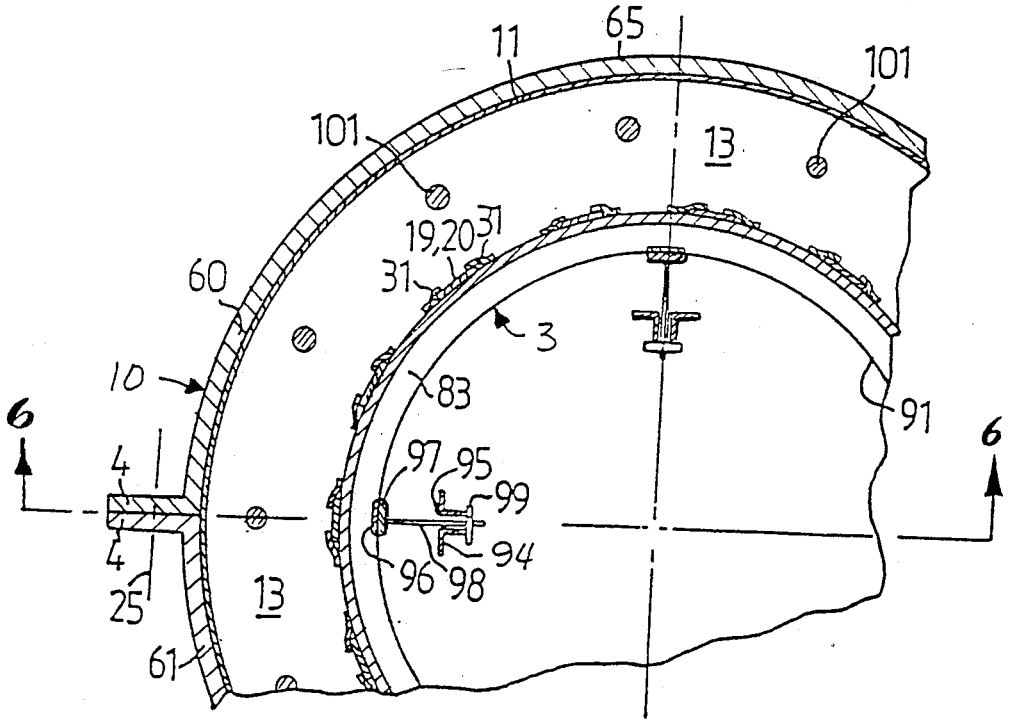
FIG. 7 is a partial transverse sectional view taken along line VII—VII of FIG. 6.

Referring now to the alternative preferred embodiment illustrated in FIGS. 6 and 7 of the accompanying drawing, essentially similar features in FIGS. 1 to 5 and 6, 7 have been given the same reference numerals.

The outer mold construction 10 shown in FIGS. 6 and 7 is essentially similar to FIGS. 1 to 5 comprising two halves 60, 61 with longitudinal adjoining flanges 4, a peripheral rigid shell wall 65 and a flexible liner 11. A permeable membrane similar to 26 may also be located between the liner 11 and the wall 65.

The inner mold construction 3 is, however, somewhat different and less complex than the construction shown in the FIGS. 1 to 3. The construction comprises a generally flexible, annular impervious membrane 18 with peripherally spaced drainage galleries 20, filters 19 and retaining strips 31 similar to the previously described embodiment. The membrane 18 is attached at its upper and lower peripheral ends to end flanges of the inner mold construction. The upper end flange 90 only is illustrated in FIG. 6. Preferably the said ends of the membrane 18 are stretched outwardly such that the remainder of the membrane, by its own elasticity, is urged inwardly.

The inner former of the inner mold construction 3 is formed by tubular member 91 formed by a woven KEVLAR-polyester cloth coated with MYLAR. KEVLAR and MYLAR are trade names representing long chain snythetic polyamide in which at least 85% of the amide linkages are attached directly to two aromatic rings. The material itself is extremely strong with minimal or no elasticity but capable of flexing in a similar manner to a relatively stiff cloth. The tubular member 91 needs to be accurately formed whereby when it is inflated under a predetermined pressure introduced into cavity 92 through opening 93, a substantially rigid former is created thereby of desired shape. In the example illustrated for creating a tapered pole, the shape of the inflated tubular material 91 is an inverted truncated cone.

To enable the desired shape to be formed, guide arrangements are attached to the tubular member 91 at peripherally spaced locations. Each of the guide arrangements preferably comprises a pair of angle iron members 94 joined to the top and bottom flanges of the inner mold 3 and extending over the full length of the mold construction. The angle iron members 94 define between themselves a guide slot 95. Attached to the outer and the inner surfaces of the tubular member 91 are longitudinally extending metal support strips 96, 97. The inner strip 97 has guide members or plates 98 secured thereto at spaced locations along the length thereof and extending radially inwardly through the slot 95 between the angle iron members 94. A transverse strip member 99 is fixed on the plates 98 and acts to limit the radial outward movement of the plates 98 and thereby the member 91. The arrangement thus described enables the tubular member 91 to collapse inwardly by flexing its wall material when pressure is removed form the internal space 92. When pressure is applied to the space 92 a rigid inner form of desired shape is formed by the member 91. This is the position illustrated in FIG. 6. In this condition, concrete of high slump consistency can be introduced into the cavity 13, preferably using a tremmie introduction method as previously described. Alternatively, the concrete might be pumped into the cavity 13. Once the cavity 13 is filled, the inner wall membrane 18 may be pressed outwardly by introducing pressurized gas into the cavity 83 through opening 100. FIG. 6 illustrates schematically the situation prior to introduction of pressure into cavity 83 and FIG. 7 illustrates schematically the situation after introduction of such pressure.

The process steps of operation of this mold assembly may be essentially the same as that previously described for the embodiment of FIGS. 1 to 5. In FIGS. 6 and 7, prestressed wires or rods 101 are illustrated in the mold cavity but it will be appreciated that a reinforcing cage might also be used in addition to or in replacement of the prestressed wires or rods illustrated.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. A method for forming an elongate molded hollow article made from concrete and comprising the sequential steps of forming a mold defining an inner and an outer surface corresponding to opposed surfaces of the molded article formed therein, said mold being arranged whereby said inner surface is movable relative to said outer surface, filling said mold with concrete, compressing the concrete by movement of said inner surface relatively towards said outer surface to remove surplus liquid from the concrete such that the concrete is given the characteristic of being at least partially cured, maintaining said compression and applying inward pressure over the outer surface of the concrete to remove surplus surface liquid from the outer surface while maintaining said compression, releasing said outer surface pressure and moving said inner surface relatively away from said outer surface to release the molded hollow article from said mold, and separating said mold from the molded hollow article.

2. A method according to claim 1 wherein the concrete is filled into said mold from one end of said mold under pressure, and where said inner surface of said mold is urged towards said outer surface of said mold prior to filling to thereby resist the pressure of the filling.

3. A method according to claim 1 wherein the concrete is filled into said mold using a tremmie adapted to traverse the length of said mold.

4. A method according to claim 1 wherein after filling of said mold said inner surface is further pressed outwardly against the concrete within said mold.

5. A method according to claim 1 wherein said inner surface of said mold includes liquid transference means for draining the surplus liquid from the concrete.

* * * * *